US005386748A

United States Patent [19]

Kilgore

[11] Patent Number: 5,386,748

[45] Date of Patent: Feb. 7, 1995

[54] OIL FILTER CUP

[76] Inventor: Gary H. Kilgore, 206 Laurel Heights Pl., San Antonio, Tex. 78212

[21] Appl. No.: 99,131

[22] Filed: Jul. 29, 1993

[51] Int. Cl.[6] ..... B25B 23/00

[52] U.S. Cl. ..... 81/180.1; 81/121.1; 7/100

[58] Field of Search ..... 81/180.1, 121.1, 3.09, 81/120; 7/100, 138; 141/98, 329, 331

[56] References Cited

U.S. PATENT DOCUMENTS 4,266,452 5/1981 Crist ..... 7/100 X
4,664,000 5/1987 Bainbridge ..... 81/121.1 X
4,800,933 1/1989 Moore et al. ..... 81/3.09 X
4,865,727 9/1989 Kranss ..... 81/121.1 X

*Primary Examiner*—D. S. Meislin

[57] ABSTRACT

This tool, fitted with an ordinary oil filter socket, is slipped over an installed vehicular oil filter. Using an ordinary socket wrench attached to the base of this tool, the oil filter is unscrewed, breaking the seal between it and its' mounting fixture. Once the seal is broken, oil discharges down the outside of the oil filter, and is confined in the Oil Filter Cup. The oil filter and oil discharge remain in the Oil Filter Cup during the process of removing the filter from its mounting fixture. Once removed, the oil filter and the Oil Filter Cup can be drained into a suitable container.

1 Claim, 3 Drawing Sheets

OIL FILTER CUP

BACKGROUND OF THE INVENTION

The Oil Filter Cup (referred to herein as "oil filter cup" and "tool") is a simple hand tool for controlling spillage of motor oil while removing oil filters during oil changes. It is designed to be used in conjunction with an ordinary socket wrench and oil filter socket.

Removal of an oil filter from any vehicle is messy, but in recent years, automobile manufacturers have exacerbated the problem by locating oil filters in poorly accessible locations. The result has been an unnecessarily messy job for the person removing the filter and environmentally undesirable oil spillage onto chassis and suspension components (and consequently, roadways); and the work area.

SUMMARY OF THE INVENTION

The Oil Filter Cup contains the oil seepage that results from breaking the seal between a vehicular oil filter and its' mounting fixture. This small feat is accomplished by attaching an ordinary oil filter socket to the male socket wrench component inside the oil filter cup; and an ordinary socket wrench to the female socket wrench component at the base of the oil filter cup. The oil filter cup is then placed over the vehicular oil filter; and pressure exerted against the ordinary socket wrench to break the seal between the oil filter and its' mounting fixture. When the seal is broken, oil seeps down the outside of the oil filter, but is contained by the oil filter cup. Thus, an oil filter in a poorly accessible location can be removed without discharging oil onto the vehicle or the work area.

I have designed the Oil Filter Cup to serve as a component of the ordinary socket wrench system. The Oil Filter Cup is a logical and economical solution to the annoying problem of uncontrolled oil discharge when the seal between an oil filter and its' mounting fixture is broken.

1. This tool allows oil seepage from the broken seal between a vehicular oil filter and its' mounting fixture to be contained during the removal procedure.

2. This tool allows oil seepage from a vehicular oil filter to be controlled until the oil can be directed into a suitable container.

PREFERRED EMBODIMENT

Figure 1:
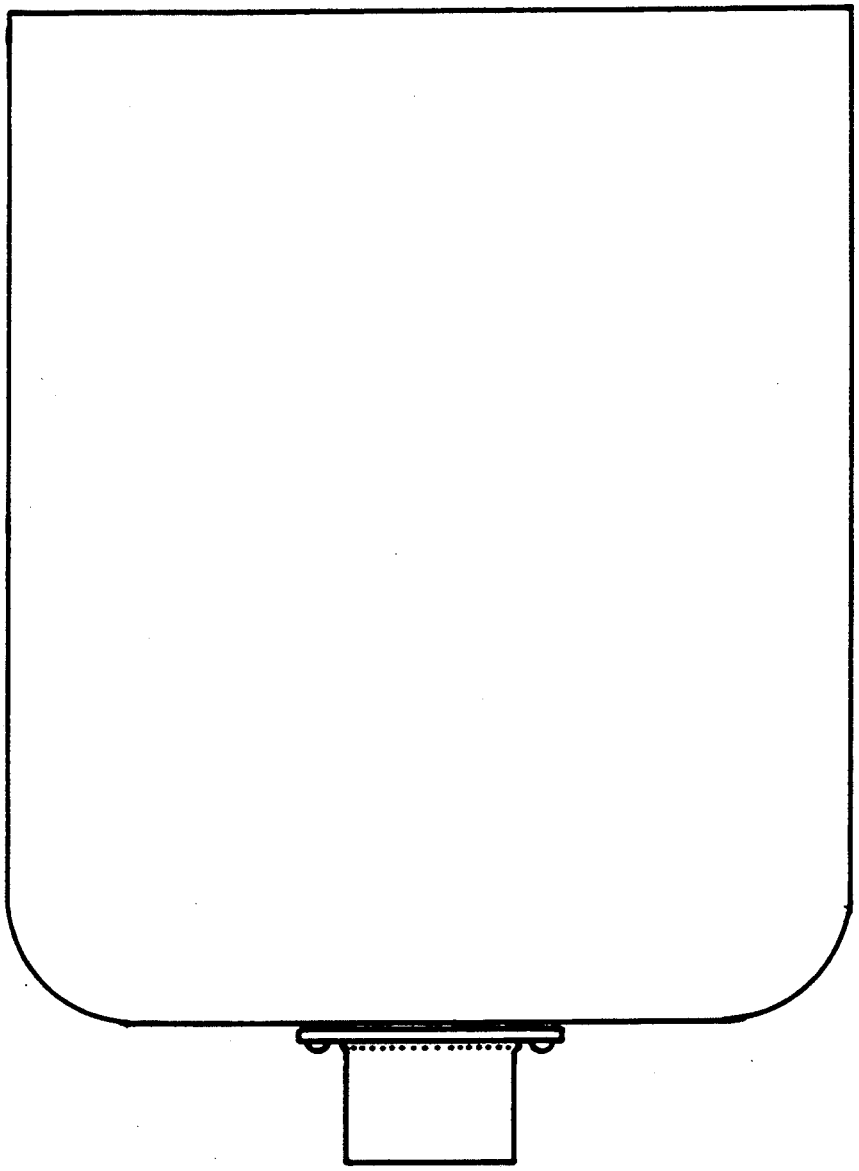
FIG. 1 illustrates an assembled Oil Filter Cup.
Figure 2:
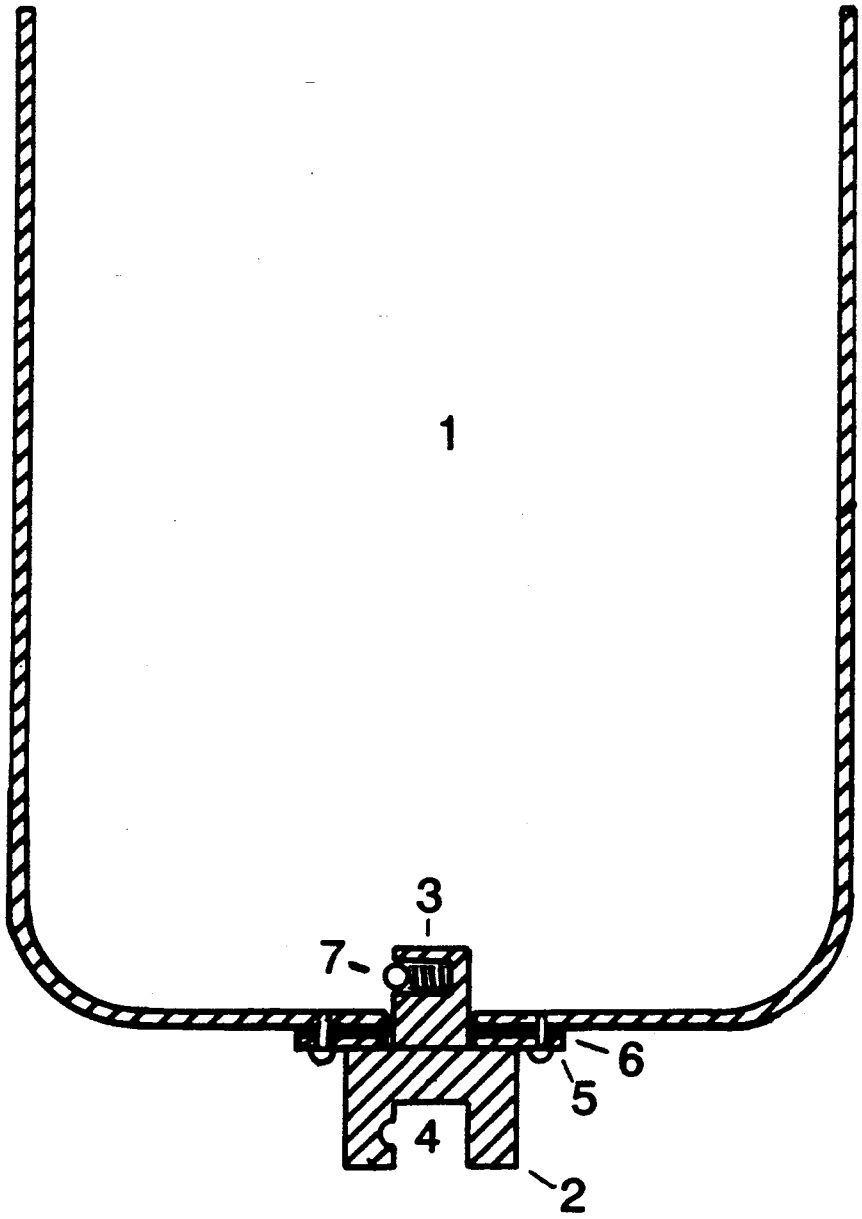
FIG. 2 illustrates an Oil Filter Cup in cross-section.
Figure 3:
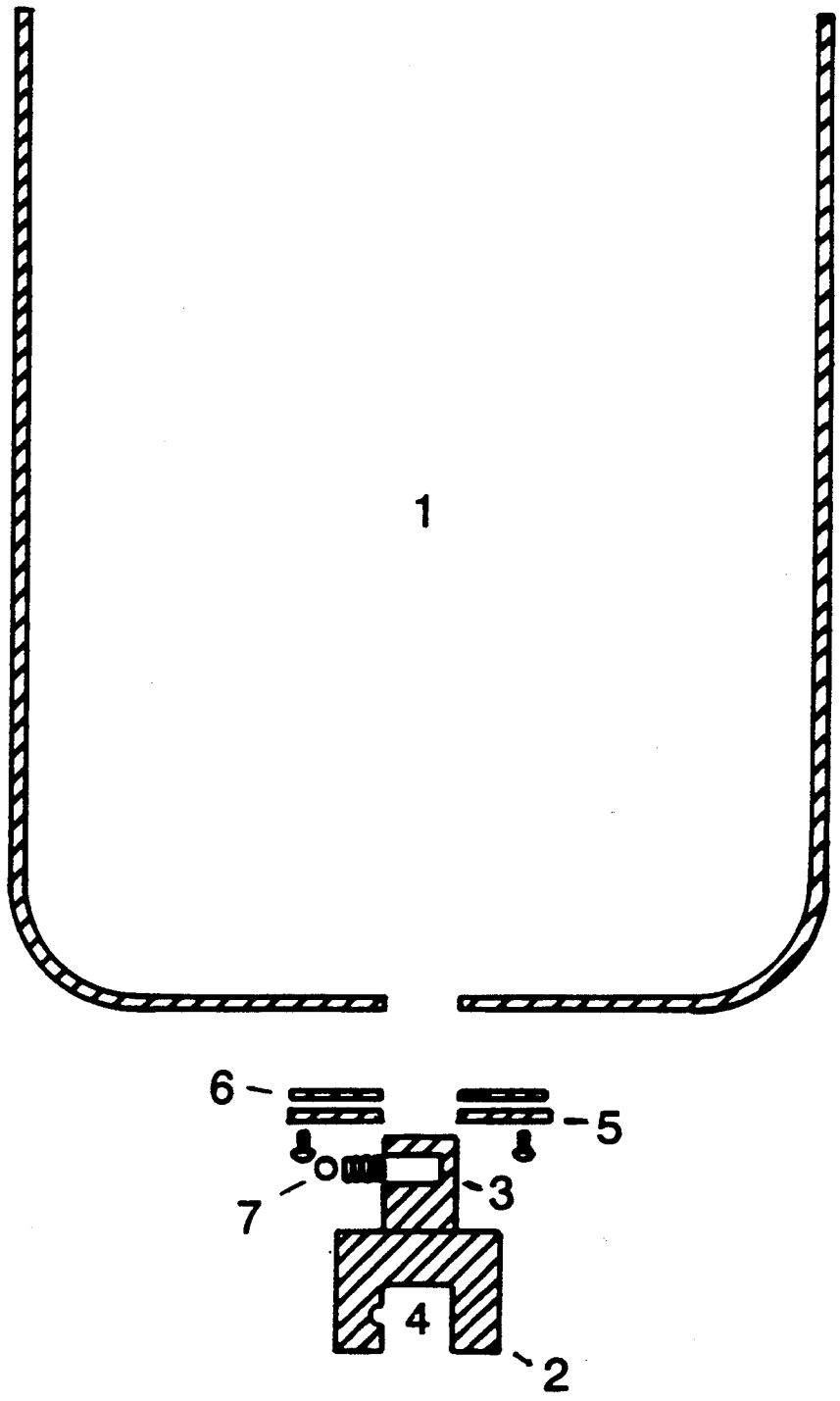
FIG. 3 illustrates an Oil Filter Cup exploded in cross-section.

An Oil Filter Cup comprises: a containment vessel (1); a metal block (2) with a male socket wrench component (3) to receive an ordinary oil filter socket at one end, and a female socket wrench component (4) to receive an ordinary socket wrench at the other end; a metal flange or washer (5), joined to the metal block, to form a bonding surface with the cup; a resilient washer (6) to seal the joint; a spring loaded ball bearing tensioner (7) to hold the ordinary oil filter socket on the male socket wrench component in the cup.

I claim:

1. An oil filter tool comprising:

a cylindrical liquid containment vessel having a first closed end, and a second open end for slipping over an oil filter;

a square male attachment and rotating means extending through an opening in the first closed end of said vessel and having a first end extending within said vessel for engagement with an ordinary oil filter socket, and having a second end;

a block attached to the second end of said square male attachment and rotating means, said block having a square female attachment and rotating means exterior of said vessel for receiving an ordinary socket wrench, said block being fixedly attached to said vessel; and seal means between said block and said vessel;

wherein oil seepage is contained within said vessel as an oil filter is removed.

* * * * *